United States Patent [19]

Maack et al.

[11] Patent Number: 4,576,032

[45] Date of Patent: Mar. 18, 1986

[54] CRIMPING PRESS CAPABLE OF CRIMPING TERMINALS ONTO A RANGE OF WIRE SIZES

[75] Inventors: Werner Maack, Seeheim; Georg Kampfmann, Darmstadt; Peter Foerster, Egelsbach, all of Fed. Rep. of Germany

[73] Assignee: AMP Incorporated, Harrisburg, Pa.

[21] Appl. No.: 635,780

[22] Filed: Jul. 30, 1984

[51] Int. Cl.[4] ..... B21J 7/12

[52] U.S. Cl. ..... 72/431; 72/465; 74/49; 384/273

[58] Field of Search ..... 72/431, 465; 74/49; 384/273, 99; 68/269 R, 269 B

[56] References Cited

U.S. PATENT DOCUMENTS

| | | | |
|---|---|---|---|
| 1,743,484 | 1/1930 | Rode | 72/465 |
| 2,563,690 | 8/1951 | Nalon | 384/99 |
| 3,304,759 | 2/1967 | Holub | 72/431 |
| 3,908,436 | 9/1975 | Bothe | 72/431 |

*Primary Examiner*—Francis S. Husar
*Assistant Examiner*—David B. Jones
*Attorney, Agent, or Firm*—Frederick W. Raring

[57] ABSTRACT

Crimping press comprises an anvil and a die which is movable towards and away from the anvil. The anvil is moved by a rotating shaft having a crank-type coupling to the die. The shaft is capable of limited movement in the direction of movement of the die towards the anvil. The shaft is supported against such movement by a yieldable shaft support that is calibrated to resiliently yield upon development of a predetermined reaction force in the die during the final stages of crimping. When a terminal is crimped onto a relatively small diameter wire, the shaft will not be moved at all or will be moved by only a slight amount if the predetermined force is reached. When a terminal is crimped onto a larger diameter wire, the predetermined reaction force will be developed before the die reaches the limit of its travel towards the anvil and the shaft will move away from the anvil to accommodate the remaining movement of the crank pin.

5 Claims, 8 Drawing Figures

CRIMPING PRESS CAPABLE OF CRIMPING TERMINALS ONTO A RANGE OF WIRE SIZES

FIELD OF THE INVENTION

This invention relates to crimping presses for crimping terminals onto wires and particularly to a crimping press which is capable of crimping terminals onto wires which lie within a range of wire sizes without adjustment to the press.

BACKGROUND OF THE INVENTION

A conventional crimping press has an anvil for supporting an electrical terminal during crimping and a die which is movable towards and away from the anvil. To crimp a terminal onto a wire, the terminal is placed on the anvil, the end of the wire is inserted into the ferrule or barrel of the terminal, and the die is caused to move towards the anvil to the limit of the stroke of the press. The die then returns to its starting position.

In order to obtain a satisfactory crimped connection, the "crimp height" of the terminal is closely controlled; the crimp height is a measure of the height or maximum vertical dimension of the terminal after crimping and ordinarily, if a terminal is not crimped to the correct crimp height for the terminal and wire combination, an unsatisfactory crimped connection will result.

In conventional crimping presses, when the wire size is changed, it is necessary to adjust the stroke of the ram of the crimping press so that the correct crimp height will be obtained for each size wire. The requirement of such adjustments to the press is a frequent cause of defective crimps. The operator may neglect to make the necessary adjustment or the operator might improperly adjust the press when a wire size is changed. Since the adjustments from one wire size to the next wire size are very slight and since the appearance of a satisfactory crimp will be very like the appearance of an imperfect crimp, terminals may be crimped by an operator without realizing that improper procedures are being followed.

The present invention is directed to the achievement of a crimping press which has the capability of crimping terminals onto wires which lie within a predetermined range of wire sizes without making any adjustments to the press. When an operator is operating a press in accordance with the invention and has available only wires which are within the predetermined range, all of the crimped connections the operator makes will be satisfactory and it is not necessary to rely on the operator to make delicate adjustments to the crimping press when the wire size is changed.

THE INVENTION

The invention comprises a crimping apparatus or press of the type comprising an anvil for supporting the terminal, a crimping die which is movable along a path of reciprocation towards and away from the anvil between the remote position and a closed or shut height position. The crimping die is moved by a rotatable power shaft which has an axis that extends normally of the path of reciprocation of the die and the shaft is coupled to the crimping die by a mechanical coupling such that the crimping die is moved to and fro during each revolution of the shaft. The apparatus is particularly characterized in that the power shaft is movable in a direction perpendicular to its axis along the path of reciprocation and away from the crimping anvil. The power shaft is supported against such movement by a resiliently yieldable shaft support. The yieldable shaft support is calibrated to resiliently yield upon development of a predetermined reaction force during the final stages of a crimping operation, the predetermined reaction force is that force which is sufficient to crimp terminals onto wires which lie within a predetermined range of wire sizes.

In accordance with further embodiments, the mechanical coupling between the power shaft and the crimping die is an eccentric type coupling comprising an eccentric crank type coupling. In accordance with a further embodiment, the shaft is supported in a first shaft bearing which is located adjacent to the mechanical coupling and a biasing means is provided which bears against the first shaft bearing and biases the bearing and the shaft towards the anvil. The first bearing is movable with the power shaft away from the anvil.

In accordance with a further embodiment, the first bearing is a two-part bearing having a movable portion and a fixed portion, the biasing means being in engagement with the movable portion and serving to maintain the movable portion against the fixed portion of the bearing. The biasing means comprises a piston rod of a pneumatic piston-cylinder and the biasing force is thereby determined by the dimensions of the piston and the pressure of the air in the piston-cylinder.

THE DRAWING DESCRIPTION

THE DISCLOSED EMBODIMENT

The principle of the invention will first be described with reference to FIGS. 1A, 1B, 2A, and 2B and a specific embodiment of the invention will then be described with reference to FIGS. 3–6.

Figure 1A:
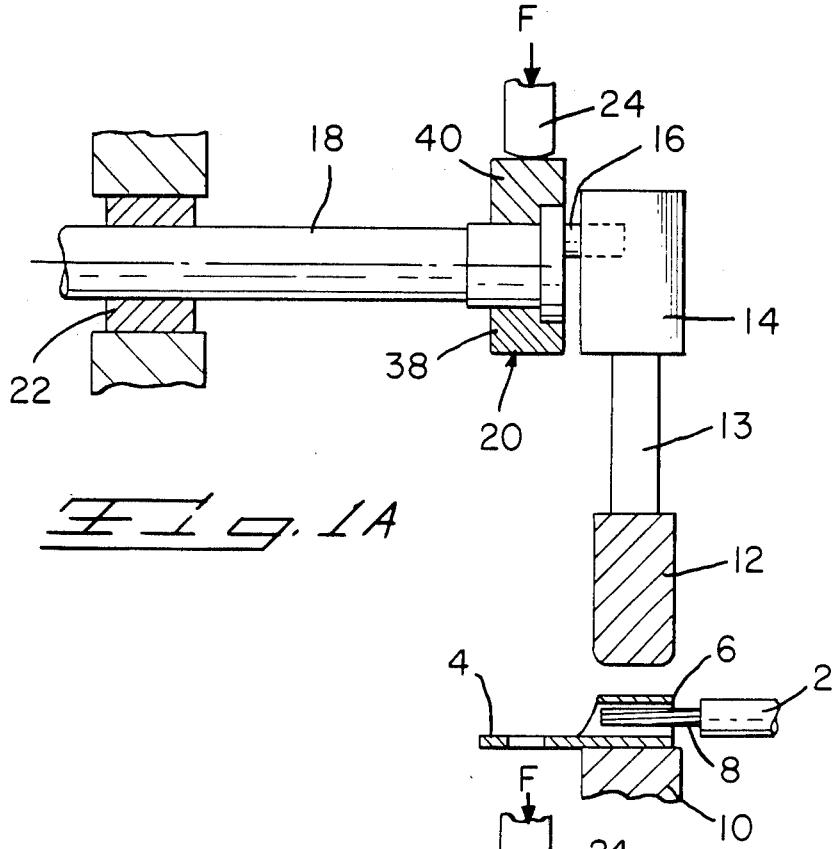
FIG. 1A is a diagrammatic view of an apparatus in accordance with the invention showing the crimping die in its remote position relative to the anvil and showing a relatively small diameter wire positioned in a terminal which is supported on the anvil.
Figure 1B:
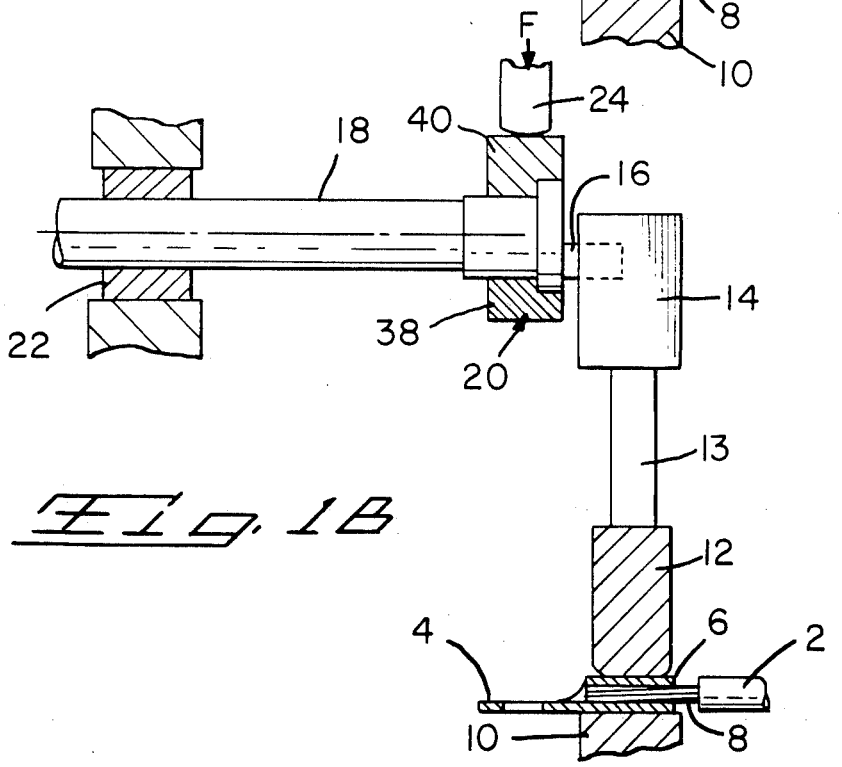
FIG. 1B is a view similar to FIG. 1A but showing the positions of the parts when the die has moved to the limit of its stroke towards the anvil and the terminal has been fully crimped onto the wire.

Referring first to FIG. 1A, the crimping press of the invention serves to crimp a terminal 4 onto the end 8 of a wire 2. The terminal has a ferrule portion 6 in which the wire is received and which is compressed onto the wire as shown in FIG. 1B. The apparatus generally comprises an anvil 10 for supporting the terminal, a crimping die 12 which is coupled by a link 13 to a block 14 mounted on a crank pin 16. The crank pin is on the end of a power shaft 18 which extends horizontally in FIG. 1A and which is supported in first and second bearing assemblies 20, 22. The shaft is upwardly movable by a very slight amount from the position shown in FIG. 1A but is maintained in the position of FIG. 1A by a yieldable shaft support 24 which bears against the bearing assembly 20 and which exerts a predetermined force F against the bearing assembly 20.

When a relatively small diameter wire 2 is to be connected to a terminal 4, the wire is inserted into the ferrule of the terminal and the shaft 18 is rotated through a single revolution to cause downward movement of the die 12 to its closed or shut height position. Since it is assumed that the wire is of a small diameter, at the lower limit of the range of wires which can be accommodated by the apparatus, the die 12 moves to the position of FIG. 1B which represents the limit of its travel towards the anvil. Under normal conditions, the reaction force developed in the terminal in which is exerted on the die is approximately equal to the force F discussed above.

Figure 2A:
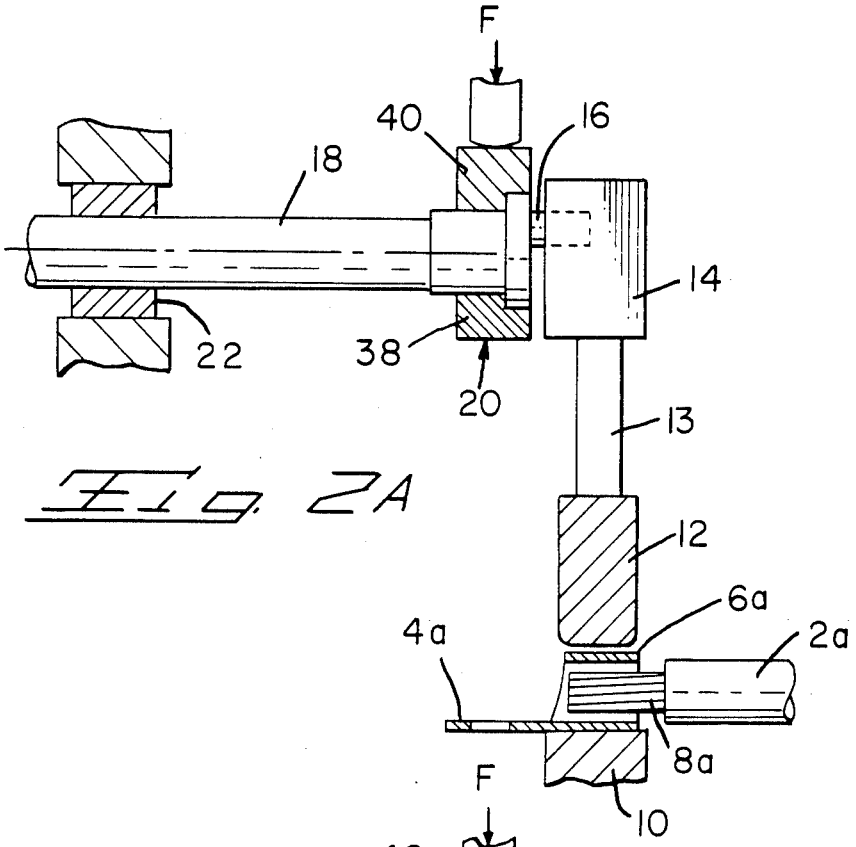
FIGS. 2A and 2B are views similar to FIGS. 1A and 1B but showing a relatively larger diameter wire and terminal being crimped.
Figure 2B:
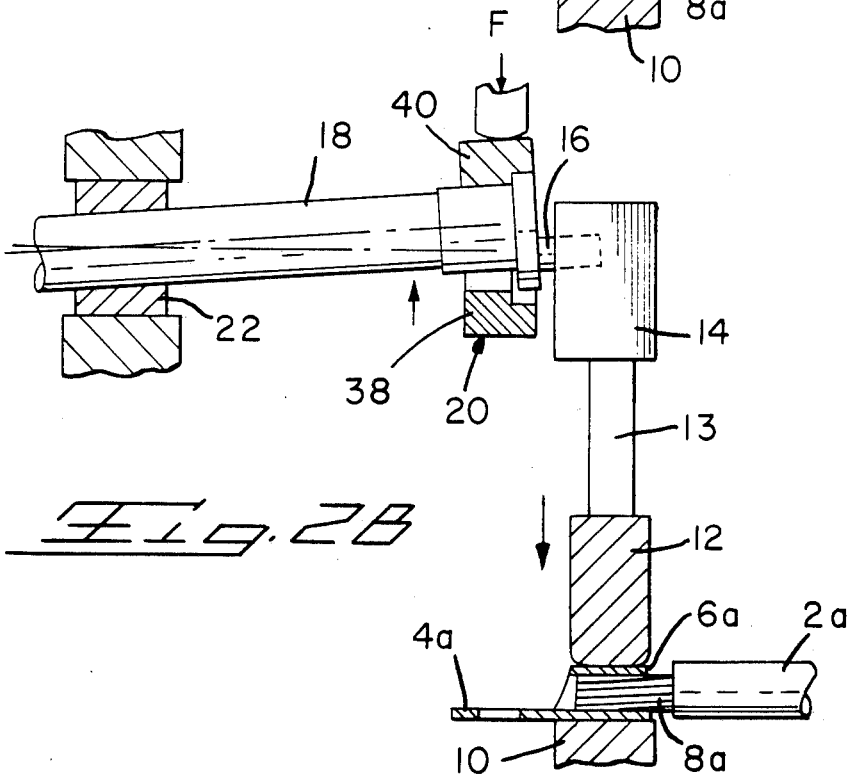
Figure 3:
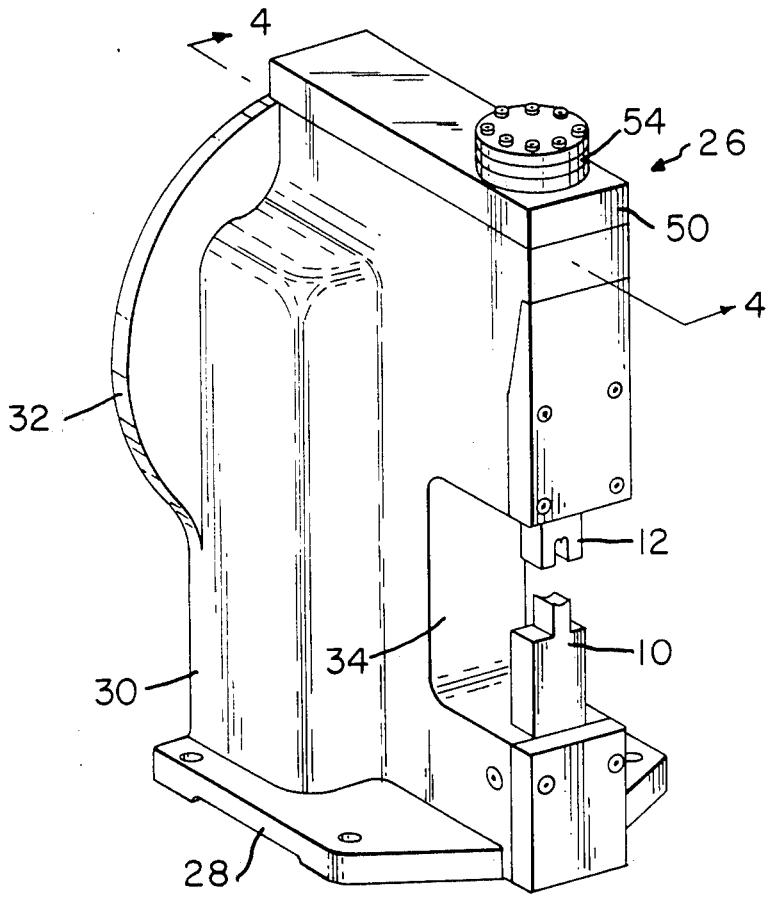
FIG. 3 is a perspective view of a bench crimping press in accordance with the invention.

Referring now to FIGS. 2A and 2B, when a terminal 4*a* is to be crimped onto a relatively large diameter wire 2*a*, the parts are positioned as explained before and the shaft 18 is caused to rotate through a single revolution. However, since the wire 2*a* has a greater diameter than the wire 2, the terminal will be fully crimped and the predetermined reaction force F will be developed prior to the end of the stroke of the die 12 towards the anvil, that is prior to the time the die 12 reaches the position of FIG. 1B. Notwithstanding the fact that the die has not reached the position of FIG. 1B, the terminal is fully crimped onto the wire when the die reaches the position of FIG. 2B. As a result, the reaction force developed in the terminal and wire overcomes the force F and the shaft is pivoted upwardly by a slight amount as shown in FIG. 2B so that the downward stroke of the die can be completed.

It will be apparent then that the terminal 4 and the terminal 4*a* are crimped onto their wires 2 and 2*a* with the same force although the final dimensions of the two terminals are different when they have been fully crimped onto the wires. No adjustments need be made to the apparatus to achieve the conditions of FIGS. 2A and 2B after the apparatus has been used to crimp smaller wires as shown in FIGS. 1A and 1B.

It should be mentioned that the movement of shaft 18 is greatly exaggerated in FIG. 2B. The difference in the diameters of the wires 2 and 2*a* is also greatly exaggerated for purposes of illustration. Also, the ferrule 6*a* of terminal 4*a* is shown as being of a greater diameter than the ferrule 6 of the terminal 4. Ordinarily, the only one size of terminal ferrule will be used for the complete range of wire diameters.

Referring now to FIGS. 3–6, a specific crimping press 26 in accordance with the invention has a base 28 and a frame 30 within which an electric motor is contained which derives a fly wheel contained in a fly wheel housing 32. The crimping die and anvil 12, 10 are mounted within a gap 34 and the shaft 18 has an enlarged diameter end portion 36 which is supported in the bearing assembly 20. This bearing assembly is a split bearing having a lower fixed portion 38 and an upper movable portion 40, the two portions being divided along a horizontal axis as viewed in FIG. 5. The upper portion is slidably supported in guides 42 which in turn are mounted on vertical guide supports 44.

Figure 5:
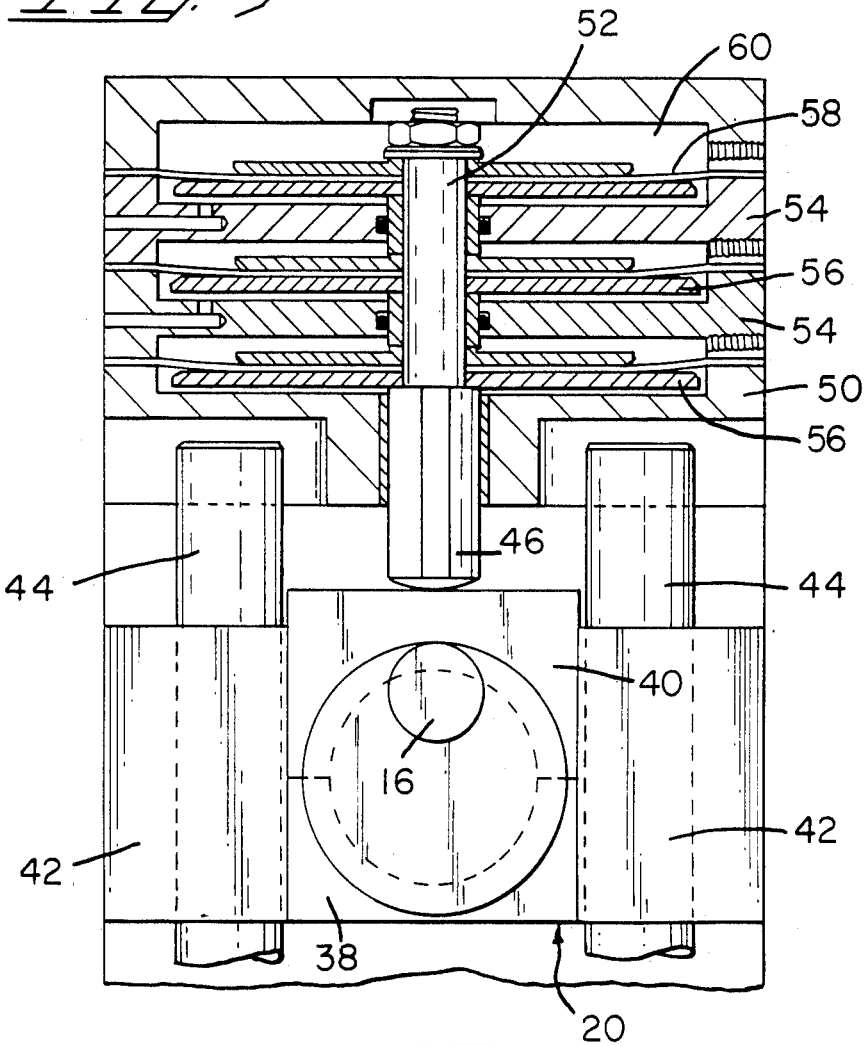
FIG. 5 is a view taken along the lines 5—5 of FIG. 4 but with the coupling member which couples the crank pin to the die removed.

The biasing force is imposed on the upper portion 40 of the bearing by a rod 46 which bears against a hardened ware plate 48 in the upper portion of the bearing. The rod 46 extends through a cover plate 50 of the frame and into a composite cylinder 54 in which it has a reduced diameter rod section 52. A plurality of spaced apart pistons 56 are mounted on the reduced diameter rod section 52, each piston comprising two plate-like members between which there is provided a membrane 58 that is captured in the walls of the cylinder 54 as shown. The chambers 60 which are above the membranes 58 are pressurized by a source of compressed air and the rod 46 is thereby urged downwardly and against the upper bearing section 40 with a predetermined force that is determined by the pressure of the air and by the dimensions of the pistons. As shown in FIG. 5, when this predetermined force is overcome by the reaction force developed during the crimping operation, the rod 46 can yield as the power shaft is moved upwardly.

Figure 4:
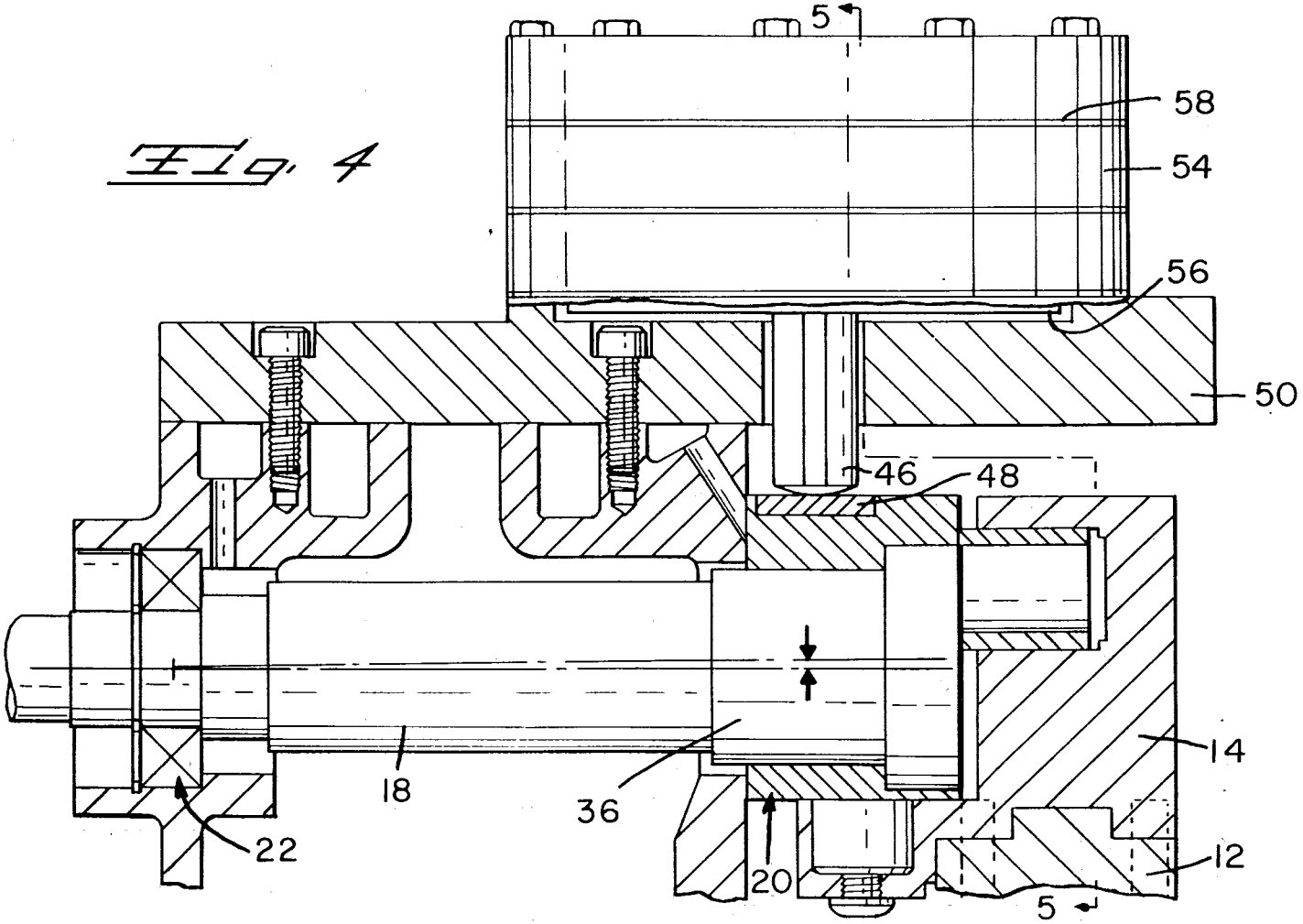
FIG. 4 is a view taken along the lines 4—4 of FIG. 3.
Figure 6:
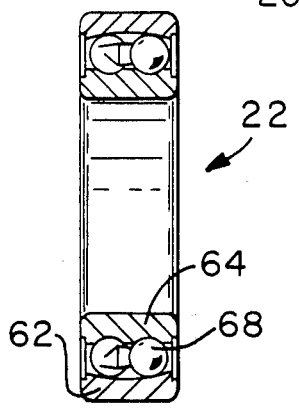
FIG. 6 is a sectional view of a type of bearing which is used to support the power shaft of the apparatus.

As shown in FIG. 4, there must be some slight movement of the shaft 18 in the vicinity of the bearing assembly 22 and such pivotal movement can be accommodated if the bearings provided at 22 are of the type commonly known as pendulum bearings, see FIG. 6. These bearings have an outer race 62, an inner race 64, and spherical bearings 68 between the surfaces of the races. The surface of the outer race is generally spherical so that the inner races pivot very slightly with respect to the outer race and such pivoting does take place when the shaft 18 is moved upwardly.

It should be mentioned that the amount of actual movement of the shaft 18 is extremely limited; if the crimping press is designed to permit movement of about 1 mm at the bearing assembly 20, and if the force F is carefully selected, the press will be capable of crimping wires of three different sizes onto terminals, for example, AWG 18, AWG 20, and AWG 22 wires can be accommodated by the crimping press without adjustment.

We claim:

1. Crimping apparatus for crimping a terminal onto a wire, the apparatus being of the type comprising an anvil for supporting the terminal, a crimping die which is movable along a path of reciprocation towards and away from the anvil between a remote position and a shut height position, a rotatable power shaft having an axis which extends normally of the path of reciprocation, a mechanical coupling between the power shaft and the crimping die for moving the crimping die to and fro along the path of reciprocation during each revolution of the power shaft and for transmitting the crimping force from the power shaft to the crimping die, the apparatus being characterized in that:

the power shaft is pivotally movable in a direction perpendicular to its axis along the path away from the crimping die, the power shaft being supported against such movement by a resiliently yieldable shaft support, the resiliently yieldable shaft support comprising a first shaft bearing which is located adjacent to the mechanical coupling and the biasing means, at least a portion of the first shaft bearing being movable with the power shaft away from the anvil, the biasing means being in engagement with the first bearing and biasing the first bearing towards the anvil, the power shaft being pivotally movable with respect to a pivot axis which is spaced along the shaft axis from the first bearing, and the yieldable shaft support is calibrated to resiliently yield upon development of a predetermined reaction force thereon during the final stages of a crimping operation, the predetermined reaction force being the force which is sufficient to crimp terminals onto wires which lie within a predetermined range of sizes whereby, the apparatus can be used without adjustment or modification to crimp terminals onto wires within the range and the shut height of the crimping die will vary for wires and terminals of different sizes within the range.

2. Crimping apparatus as set forth in claim 1 characterized in that the mechanical coupling between the power shaft and the crimping die is an eccentric type coupling.

3. Crimping apparatus as set forth in claim 2 characterized in that the mechanical coupling comprises a crank-type coupling.

4. Crimping apparatus as set forth in claim 1 characterized in that the first bearing is a two-part bearing having a movable portion and a fixed portion, the biasing means being in engagement with the movable portion and serving to maintain the movable portion against the fixed portion.

5. Crimping apparatus as set forth in claim 4 characterized in that the biasing means comprises the piston rod of a pneumatic piston-cylinder.

* * * * *